United States Patent [19]

Honegger

[11] Patent Number: 4,597,243

[45] Date of Patent: Jul. 1, 1986

[54] METHOD AND APPARATUS FOR THE STORAGE OF PRODUCTS, ESPECIALLY PRINTED PRODUCTS, ARRIVING CONTINUOUSLY, ESPECIALLY IN AN IMBRICATED FORMATION

[75] Inventor: Werner Honegger, Tann-Rüti, Switzerland

[73] Assignee: Ferag AG, Hinwil, Switzerland

[21] Appl. No.: 634,029

[22] Filed: Jul. 24, 1984

[30] Foreign Application Priority Data

Jul. 29, 1983 [CH] Switzerland ..... 4162/83

[51] Int. Cl.[4] ..... B65B 63/04; B65H 17/02

[52] U.S. Cl. ..... 53/430; 53/118

[58] Field of Search ..... 53/430, 118, 117, 116; 271/204; 242/67.1 R, 59, 67.4, DIG. 2

[56] References Cited

U.S. PATENT DOCUMENTS

| | | | |
|---|---|---|---|
| 1,902,312 | 3/1933 | Rous | 206/412 |
| 4,039,182 | 8/1977 | Reist et al. | 271/204 X |
| 4,438,618 | 3/1984 | Honegger | 53/430 |
| 4,494,359 | 1/1985 | Honegger | 53/430 |

FOREIGN PATENT DOCUMENTS

| | | |
|---|---|---|
| 2107681 | 5/1983 | United Kingdom . |
| 2111028 | 6/1983 | United Kingdom . |
| 2112758 | 7/1983 | United Kingdom . |

*Primary Examiner*—James F. Coan

*Attorney, Agent, or Firm*—Werner W. Kleeman

[57] ABSTRACT

A first subformation of an arriving imbricated product formation is sub-divided into an initial section, an intermediate section and a terminal section. There is also subsequently formed from the arriving imbricated product formation a second subformation adjunct to the first subformation. These subformations are formed by releasing the grippers of a delivery device at one release point or another. The intermediate section is wound up to form an intermediate coil or wound package, while the initial and terminal sections are first conducted into a branch conveying path. The initial and terminal sections are then adjoined to the front and rear ends of the intermediate section wound off the intermediate coil to complete the first subformation. The initial, intermediate and terminal sections of the first subformation are wound up together with the second subformation to form a storage coil or wound package upon a winding mandrel or core.

27 Claims, 15 Drawing Figures

1
2
3
4
5
5a
5b
5c
8
9
10
11
12
13
14
15
16
17
18
19
20
24a
26
30'
32
33
35
36
37
39
39a
39b
39c
40'
42'
45a
45b
45c
46b
47
B
D
E
E'
E''
F'
G

METHOD AND APPARATUS FOR THE STORAGE OF PRODUCTS, ESPECIALLY PRINTED PRODUCTS, ARRIVING CONTINUOUSLY, ESPECIALLY IN AN IMBRICATED FORMATION

CROSS-REFERENCE TO RELATED APPLICATIONS

This application is related to the commonly assigned, co-pending U.S. patent applications Ser. No. 06/580,210, filed Feb. 15, 1984 and entitled METHOD AND APPARATUS FOR STORING CONTINUOUSLY ARRIVING FLAT STRUCTURES, ESPECIALLY PRINTED PRODUCTS ARRIVING IN AN IMBRICATED PRODUCT FORMATION, since granted as U.S. Pat. No. 4,528,728 on July 16, 1985, and Ser. No. 06/338,568, filed Jan. 11, 1982 and entitled METHOD AND APPARATUS FOR LONG-TERM PRESSING OF PRINTED PRODUCTS, ESPECIALLY NEWSPAPERS, since granted as U.S. Pat. No. 4,494,359 on Jan. 22, 1985.

BACKGROUND OF THE INVENTION

The present invention broadly relates to a method and apparatus for storing flat products arriving in continuous formation and, more specifically, pertains to a new and improved method and apparatus for the storage of flat products, especially printed products, continuously arriving, especially in an imbricated formation.

Generally speaking, the method of the present invention serves for the storage of substantially flat products, especially printed products, arriving in a continuous formation, especially an imbricated product formation, wherein the products of a first, precursive subformation of the arriving formation and the products of a second subformation of the arriving formation following the first subformation, after a preliminary winding-up of the products of the first subformation to form an intermediate coil or wound package, are simultaneously and conjointly wound up at a winding station to form a storage coil or wound package.

The apparatus of the present invention is of the type serving for the storage of substantially flat products, especially printed products, delivered in a continuous formation, especially an imbricated formation, by a delivery device and comprising a first winding mandrel arranged at a first winding station and drivable in a first winding direction for forming a storage coil or wound package and a second winding mandrel arranged at a second winding station and drivable in a second winding direction counter to the first winding direction for forming an intermediate coil. The delivered continuous formation comprises a first, precursive subformation and a second subformation following the first subformation. A conveyor device delivers products of the first subformation and products of the second subformation simultaneously to the first winding station and delivers products of the first subformation to the second winding station.

A method and an apparatus of this type is known from the British Patent Publication No. 2,111,028 corresponding to the copending U.S. patent application Ser. No. 06/445,565, filed Nov. 29, 1982. This method and apparatus permits the formation of a main or intermediate coils or wound packages whose coil layers are formed by two mutually superposed imbricated product formations. When emptying or unwinding this storage coil, both such formations are wound off conjointly and one formation is directly conducted away while the other formation is first wound up to an intermediate coil and then conducted away at the rear of the first formation (cf. British Patent Publication No. 2,112,758 corresponding to the copending U.S. patent application Ser. No. 06/445,564, filed Nov. 29, 1982) and since granted as U.S. Pat. No. 4,525,982 on July 2, 1985. Both in forming and in unwinding the storage coil, a certain amount of time is required for changing the direction of rotation of the intermediate coil when switching over from winding-up to unwinding and vice versa. This is a reason that, for continuously delivered products, it is not readily possible to process all arriving products with a single intermediate coil and a single storage coil such that the conjointly wound-up formations permit the reformation of a continuous formation when later unwinding the storage coil.

SUMMARY OF THE INVENTION

Therefore, with the foregoing in mind, it is a primary object of the present invention to provide a new and improved method and apparatus for the storage of substantially flat products which do not exhibit the aforementioned drawbacks and shortcomings of the prior art constructions.

Another and more specific object of the present invention aims at providing a new and improved method and apparatus for the storage of substantially flat products of the previously mentioned type which permit the formation of a storage coil from all of these flat products even when they arrive continuously with the simplest possible means and in which the conjointly wound-up formations have the requisite length and mutual orientation for a correct unwinding later.

Yet a further significant object of the present invention aims at providing a new and improved method and apparatus for the storage of substantially flat products of the character described which are relatively simple in concept, extremely economical to realize, highly reliable in operation, not readily subject to malfunction and require a minimum of attention.

Now in order to implement these and still further objects of the invention, which will become more readily apparent as the description proceeds, the method of the present invention is manifested by the features that it comprises the steps of separating an initial section and a terminal section of the first subformation from an intermediate section lying therebetween, winding up only products of the intermediate section to form an intermediate coil and adjoining the initial section before and the terminal section after the intermediate section unrolled from the intermediate coil before conjointly winding up both the first and the second subformations to form a storage coil.

The apparatus of the present invention is manifested by the features that it comprises selective deposition means for dividing the first subformation into an initial section, a terminal section and an intermediate section, conveyor means for conducting the intermediate section to and from the second winding station, and branch conveying path means for adjoining the initial section at the front of and the terminal section at the rear of the intermediate section which is unwound from the intermediate coil before winding up on the first winding mandrel of the first winding station.

The beginning or initial section and the end or terminal section of the first, precursive subformation are thus first separated from the middle or intermediate section, which is then wound up to form an intermediate coil or wound package, and then conducted to the storage or main coil or wound package immediately before, respectively just after, the intermediate section unwound from the intermediate coil or wound package. In this manner, even with continuously arriving products and with only a single intermediate coil and only a single main coil, there is available the requisite time for changing the direction of rotation of the intermediate coil. It is furthermore possible to form the first, precursive subformation to be longer than the other, second subformation directly conducted to the storage coil and to unite the latter with the first, precursive subformation before the conjoint winding-up operation upon the storage coil such that the first, precursive subformation protrudes at both ends. This double protrusion of that subformation which is precursive in the arriving product formation supplies the prerequisite for the availability of sufficient time for reversing the direction of rotation of the intermediate coil when later unwinding and therefore for the reformation of a continuous, uninterrupted imbricated product formation.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figures 1, 1A:
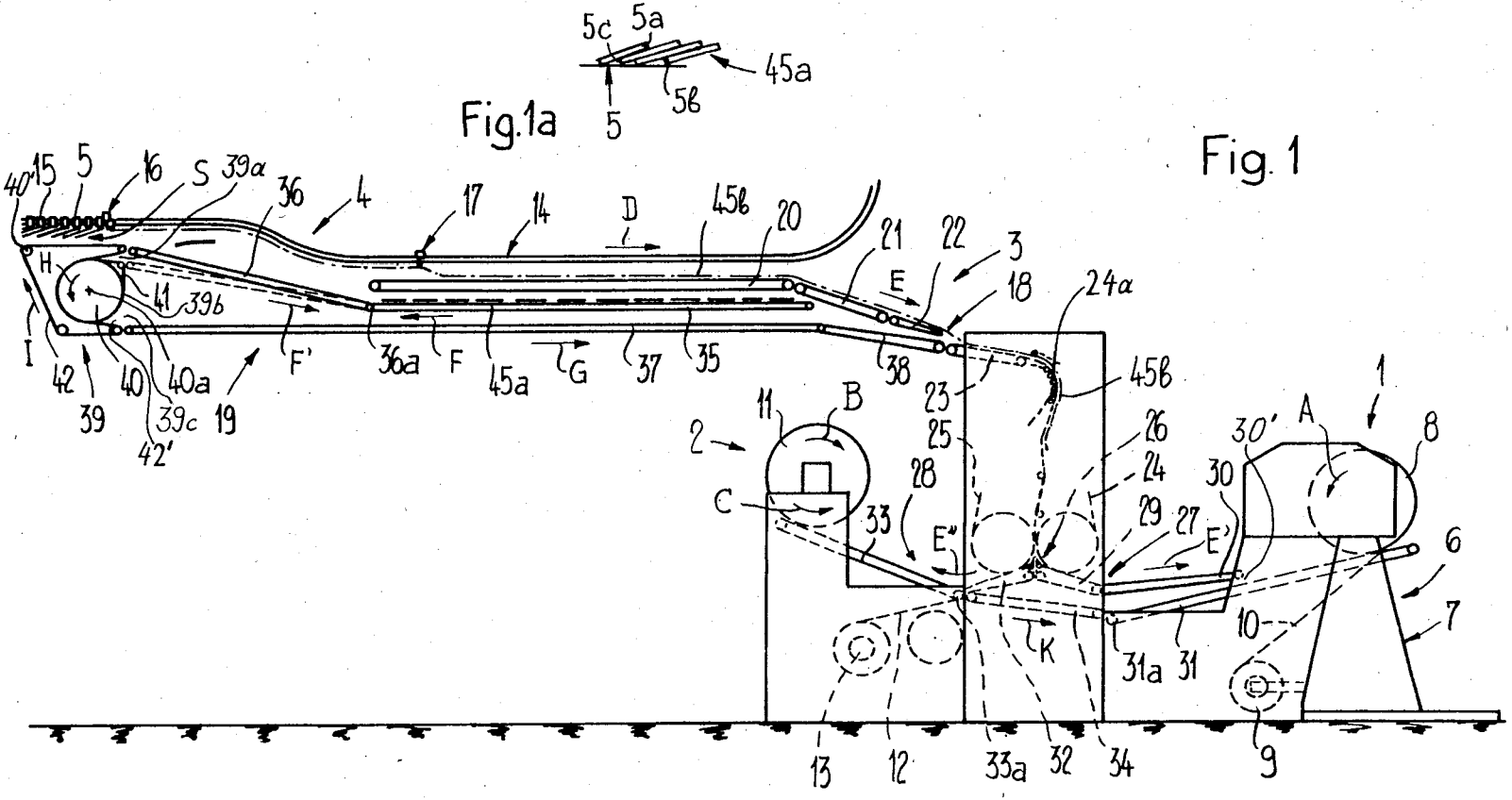
FIGS. 1 through 6 schematically show elevational views of a plant or installation for the storage of printed products arriving in imbricated product formation in the form of a storage coil or wound package in various stages of coil formation.

Describing now the drawings, it is to be understood that to simplify the showing thereof only enough of the structure of the apparatus for the storage of substantially flat products has been illustrated therein as is needed to enable one skilled in the art to readily understand the underlying principles and concepts of this invention. Turning now specifically to FIG. 1 of the drawings, the apparatus illustrated therein by way of example and not limitation and employed to realize the method as hereinbefore described will be seen to comprise two winding stations or locations 1 and 2 which communicate via a delivery or infeed device 3 with a supply or transport device 4 which supplies the printed products 5 to be wound up in an imbricated product formation S (see also FIG. 7).

A winding and storage unit 6 is located in the winding station 1 whose construction and operation is described in detail in the British Patent Publication No. 2,107,681 and the corresponding U.S. patent application Ser. No. 06/432,557, filed Oct. 4, 1982. This winding and storage unit 6 comprises a mobile frame or support 7 in the form of a bearing pedestal. A winding mandrel or core 8 is rotatably journaled in the frame 7 and is driven by any suitable drive means not particularly illustrated in the direction of the arrow A. A supply roll 9 carrying a winding strap or band 10, also called a separator band, is also journaled in the frame 7. This winding strap or band 10 is made of tension-resistant material and is fastened at one of its ends to the winding mandrel or core 8. When the winding mandrel or core 8 is rotated, this winding strap or band 10 is drawn off the supply roll 9 and maintained under tension by suitable conventional means not particularly shown, such as a brake unit.

A second winding mandrel or core 11 is located at the other winding station 2 and is rotatably journaled and can be selectively driven in the direction of the arrow B or in the direction of the arrow C by suitable conventional drive means also not particularly shown. The end of a winding strap or band 12 made of tension-resistant material is connected with this winding mandrel or core 11. When the winding mandrel or core 11 is rotated, the winding strap or band 12 unwinds from a supply roll 9, respectively rolls up upon the latter. Not particularly shown conventional means, again for instance a brake unit, are present to place the winding strap or band 12 under tension as it winds up on the winding mandrel or core 11.

The supply device 4 is constructed as a transporter 14 of conventionally known type, whose construction is explained in more detail in the U.S. Pat. No. 3,955,667, granted May 11, 1976. This transporter 14 comprises grippers 15 arranged sequentially in the transport or conveying direction D and which are individually releasable and grasp the printed products 5 at their leading edges. First and second releasing devices 16 and 17 are sequentially arranged in mutual spaced relationship in the transport or conveying direction D for opening the grippers 15.

The delivery device 3 following the supply device 4 comprises a main conveying path designated with the reference numeral 18 and a branch conveying path 19. A portion of the printed products 5 delivered by the supply device 4 is conducted in a manner which will be described in more detail below through the main conveying path 18 either to the first winding station 1 or to the second winding station 2. Another portion of the printed products 5 supplied by the transporter 14 is conducted in a manner also to be described in more detail below through the branch conveying path 19 which leads into the main conveying path 18.

A first belt conveyor 20 is arranged in the main conveying path 18 and is situated beneath the transporter 14. Further belt conveyors 21, 22 and 23 follow this first belt conveyor 20. An essentially vertically extending conveying path or run **24*a* is arranged subsequent to the belt conveyor 23 and is largely defined by two mutually opposing belt conveyors 24 and 25 having between them a gap defining the conveying path or run 24*a*. A not particularly shown switch or turnout 26 follows these belt conveyors 24 and 25 for dividing the main conveying path 18 into two laterally extending conveying paths 27 and 28. A belt conveyor 29 is arranged in the laterally extending conveying path 27**.

A further belt conveyor 30 constructed as a balance or rocker arm is arranged subsequent to the belt conveyor 29. The belt conveyor 30 is journaled at its end nearest the belt conveyor 29 to pivot about an axis extending substantially perpendicular to the plane of the drawing.

A further belt conveyor 31 constructed as a balance or rocker arm is arranged beneath the winding mandrel or core 8 to extend thereto. The belt conveyor 31 is also journaled at its end 31*a* to pivot about an axis extending substantially perpendicular to the plane of the drawing.

A belt conveyor 32 constructed as a balance or rocker arm is arranged subsequent to the switch or turnout 26 in the other conveying path 28. This belt conveyor 32 is also journaled at its end nearest the switch or turnout 26 to pivot about an axis extending substantially perpendicular to the plane of the drawing.

A further belt conveyor 33 constructed as a balance or rocker arm is arranged subsequent to the belt conveyor 32 and beneath the winding mandrel or core 11 to extend thereto. This belt conveyor 33 is journaled at its end 33*a* to pivot about an axis extending substantially perpendicular to the plane of the drawing.

Another belt conveyor 34 is arranged to connect the belt conveyor 33 with the belt conveyor 31 leading to the winding mandrel or core 8. A still further belt conveyor 35 is arranged beneath the first belt conveyor 20 and is associated with the branch conveying path 19.

A belt conveyor 36 constructed as a balance or rocker arm is arranged subsequent to the belt conveyor 35. This belt conveyor 36 is journaled at its end 36*a* to pivot about an axis extending substantially perpendicular to the plane of the drawing.

The two belt conveyors 35 and 36 are selectively drivable in the direction of the arrow F or in the direction of the arrow F'. A belt conveyor 37 is arranged beneath these two belt conveyors 35 and 36 and has a transport direction G. A belt conveyor 38 is arranged to connect the belt conveyor 37 with the belt conveyor 23 of the main conveying path 18.

The belt conveyor 37 is arranged subsequent to an outlet or exit 39*c* of a turning or inverting and reversing device 39 on the side opposite the belt conveyor 38. The belt conveyor 36 can be adjoined to the inlet or entry 39*a* of the product turning device 39.

The turning device 39 comprises a turn or deflecting guide roll 40 which is rotatable in the direction of the arrow H about its axis 40*a* extending substantially perpendicular to the plane of the drawing. This turn guide roll 40 is driven by at least one drive belt 41 in conventional manner. One run or leg 42' of an endless support belt 42 runs along a portion of the periphery or circumference of the turn guide roll 40 and is guided over guide rollers 40' and is driven in circulation in the direction of the arrow I in conventional manner. A conveying gap 39*b* is formed between the turn guide roll 40 or, respectively, the drive belt 41 and the previously mentioned run or leg 42' of the support belt 42.

Figure 7:
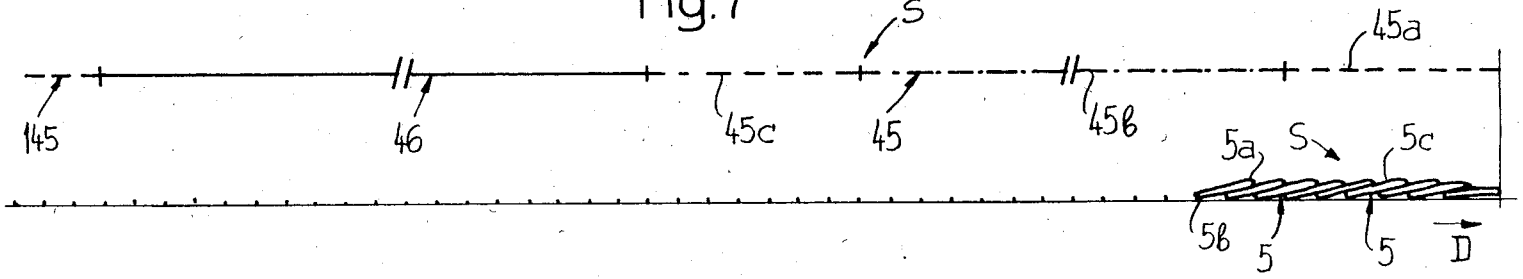
FIG. 7 schematically shows in elevational view the division of the arriving imbricated product formation into various subformations and sections.

As already mentioned and as can be seen in the lower part of FIG. 7, the transporter 14 delivers the printed products 5 to be wound in an imbricated product formation S in which each printed product 5 overlaps the preceding printed product 5. This means that the leading edges 5*a*, which are usually the folded edges of the printed products 5, lie upward in the arriving imbricated formation S, while the trailing edges 5*b* are overlapped by the following printed products 5.

The sides of the printed products 5 which are upper sides in the imbricated formation S delivered by the transporter 14 are designated with the reference character 5*c*. The upper part of FIG. 7, in which the delivered imbricated formation S is represented schematically, serves to clarify the division of the delivered imbricated product formation S in a manner to be described below.

As will be seen from this illustration, the imbricated product formation S is divided into a first, precursive or leading subformation 45, respectively 145, and a subsequent second subformation 46.

The first subformation 45 is further divided into an initial section 45*a* (represented in dotted line), an intermediate section 45*b* (represented in chain-dotted line) and a terminal section 45*c* (again represented in dotted line). Each of these subformations and sections 45*a*, 45*b*, 45*c* and 46 comprises a more or less large number of printed products 5 overlapping one another in imbricated formation. The first subformation 45 is longer than the second subformation 46. The initial and terminal sections 45*a* and 45*c* of the first subformation 45 are considerably shorter than the intermediate section 45*b* thereof. The procedure of winding up the arriving or delivered printed products 5 to a storage coil or wound product package will be explained in more detail in the following.

Initially, the belt conveyor 36 is situated in its upper position represented in solid line and is driven in the direction of the arrow F', just as is the subsequent belt conveyor 35. The first releasing device 16 is active and effects an opening of those grippers 15 which deliver or deposit the printed products 5 of the initial section 45*a*. The initial section 45*a* is therefore deposited upon the belt conveyor 36 and conducted to the belt conveyor 35. The belt conveyors 35 and 36 are halted when the initial section 45*a* has been deposited.

As soon as the last printed product 5 of the initial section 45*a* has been deposited, the first releasing device 16 is rendered inactive and the subsequent grippers 15 now delivering the printed products 5 of the intermediate section 45*b* run past the first, now inactive, releasing device 16 without being opened and continue onward to the active second releasing device 17. The printed products 5 of the intermediate section 45*b* released due to the opening of the grippers 15 by this second releasing device 17 are deposited upon the belt conveyor 20 of the main conveying path 18 and are conveyed over this main conveying path 18 in the direction of the arrow E to the switch or turnout 26. FIG. 1 shows this stage of the winding process. The printed products 5 have the same position or orientation within the section 45*b* conducted over the main conveying path 18 to the switch or turnout 26 as in the arriving or delivered imbricated product formation S. The mutual position or orientation of the printed products 5 in the initial section 45*a* deposited upon the belt conveyor 35 is shown in FIG. 1*a*.

Figures 2, 2A, 2B:
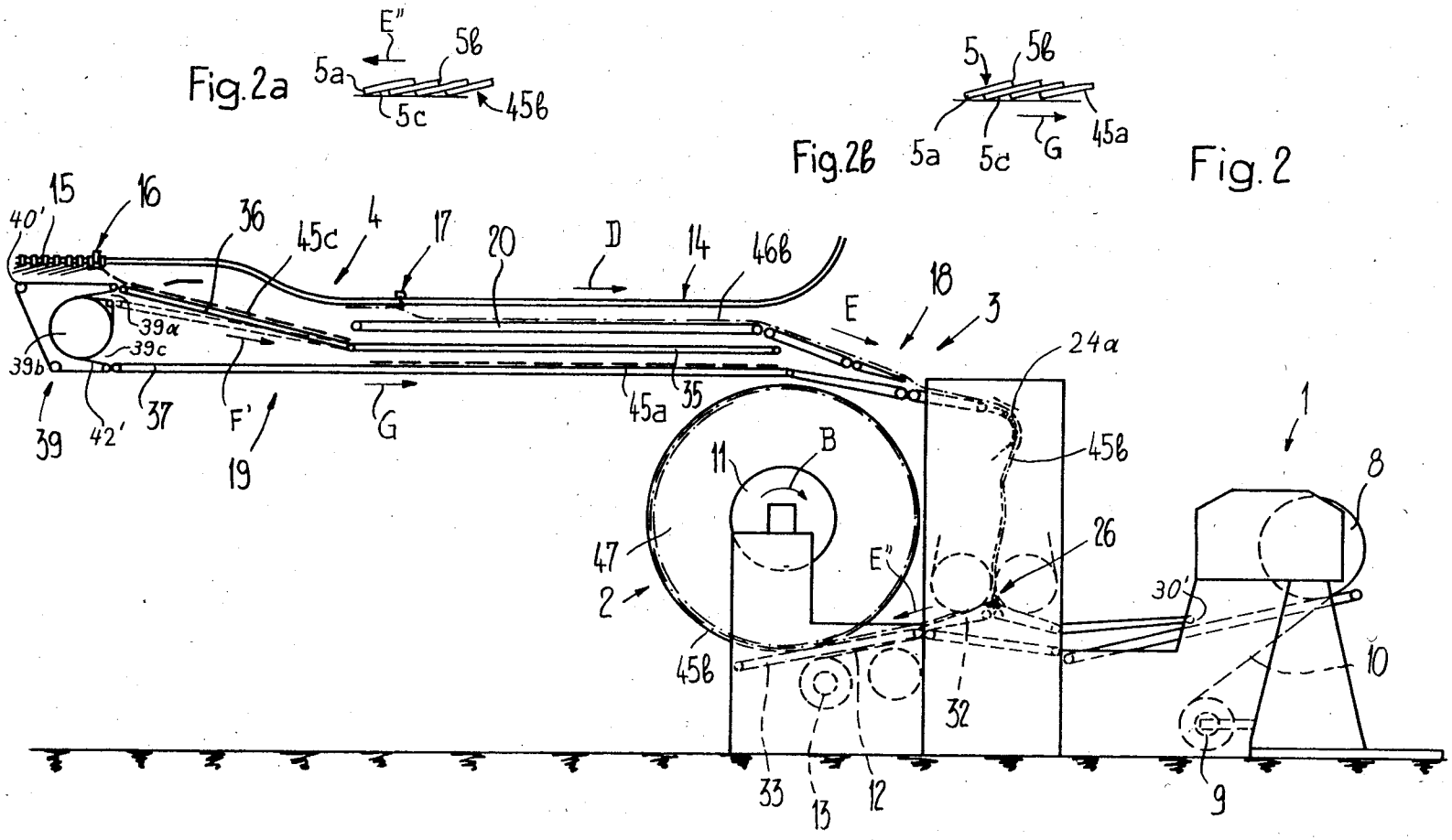

The switch or turnout 26 is thrown such that the intermediate section 45*b* is routed to the lateral conveying path 28, i.e. is conducted via the belt conveyors 32 and 33 to the second winding mandrel or core 11. The latter is driven in the direction of the arrow B so that the intermediate section 45*b* is wound up upon the winding mandrel or core 11 conjointly with the winding strap or band 12 to form an intermediate coil or wound package 47 (cf. FIG. 2). As shown in FIG. 2*a*, the printed products 5 have, due to the turning or reversing of the intermediate section 45*b*, a different mutual position or orientation within this section 45*b* than they did within the delivered imbricated product formation S. In the product formation approaching the winding mandrel or core 11, respectively the intermediate coil or wound package 47 forming thereupon, each printed product 5 now lies upon the following printed product 5. The leading edges 5*a* are still formed by the same product edges (the folded edges) as in the arriving or delivered imbricated product formation S, but these leading edges 5a are now situated upon the underside of the product formation. The sides 5c forming upper sides in the arriving imbricated product formation S are also situated on the underside of the product formation.

While the intermediate section 45b is wound up to an intermediate coil or wound package 47 in the manner described, the initial section 45a situated upon the belt conveyor 35 is conducted, after pivoting the balance or rocker arm 26 into the position shown in dotted line, in the direction of the arrow F toward the inlet 39a of the product turning device 39. After passing through the product turning device 39, the initial section 45a arrives at the belt conveyor 37 where it temporarily remains in a waiting position or state, as can be seen in FIG. 2. In the initial section 45a situated on the belt conveyor 37, the printed products 5 have the mutual position or orientation shown in FIG. 2b. Seen in the conveying direction G of the belt conveyor 37, each printed product 5 still lies upon the preceding printed product 5 but the leading edge 5b is now formed by that edge which was the trailing edge in the arriving imbricated product formation S. Furthermore, the sides 5c of the printed products 5 which were the upper sides in the arriving imbricated product formation S now lie upon the underside of the formation.

Figure 3:
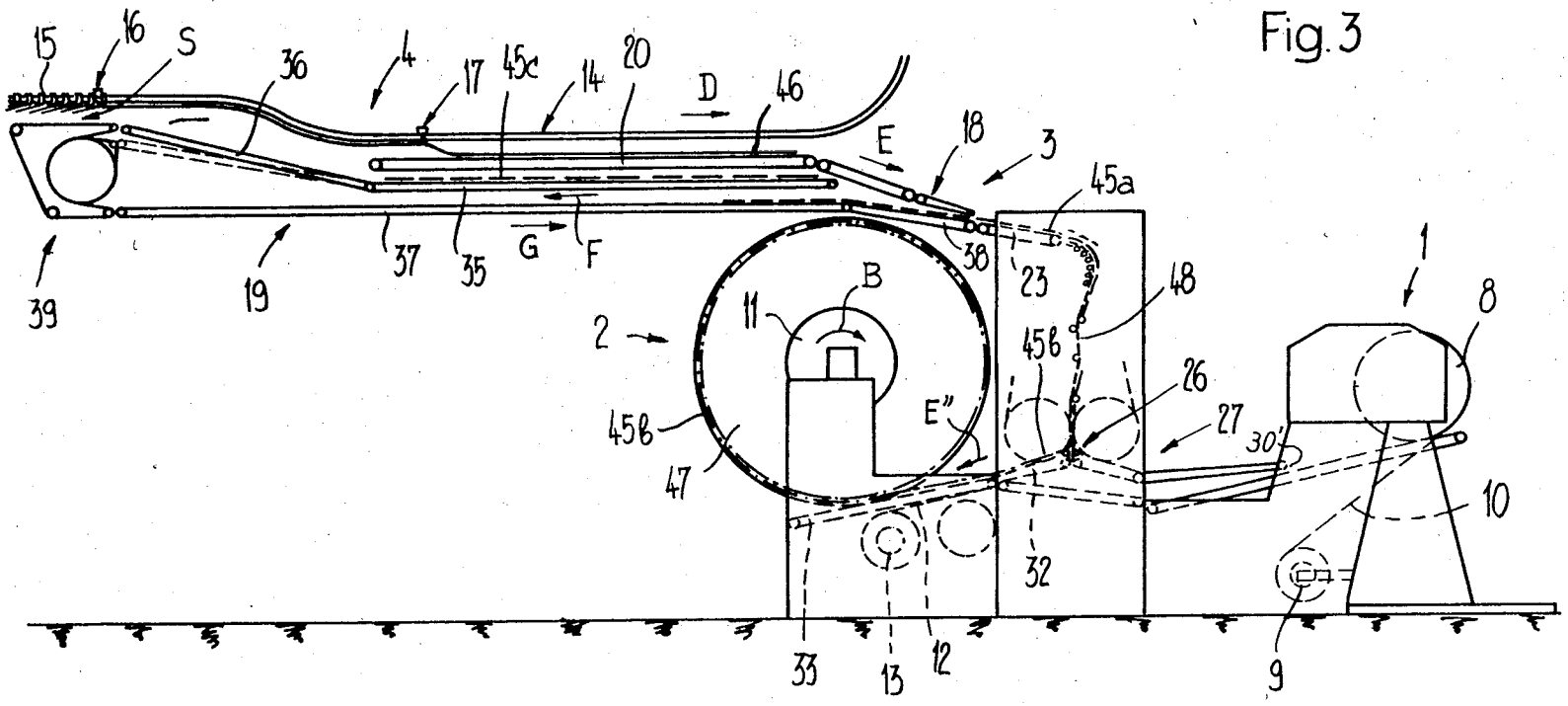

As can further be seen from FIG. 2, the forward or first releasing device 16 is made active again as soon as those grippers 15 which delivered the last printed product 5 of the intermediate section 45b have passed this first releasing device 16. Thus the subsequent printed products 5 which belong to the terminal section 45c are deposited upon the belt conveyor 36 just as the printed products 5 of the initial section 45a before them and are transported to the belt conveyor 35 upon which the terminal section 45c assumes a waiting position or state, as can be seen in FIG. 3.

When the rear end of the intermediate section 45b passes the location at which the branch conveying path 19 enters into the main conveying path 18, the initial section 45a is conducted by the belt conveyors 37 and 38 to the belt conveyor 23 and therefore into the main conveying path 18. The initial section 45a now follows the intermediate section 45b along the main conveying path 18 at a certain distance or spacing. The gap between the intermediate section 45b and the initial section 45a is designated with the reference numeral 48 in FIG. 3.

Figures 4, 4A:
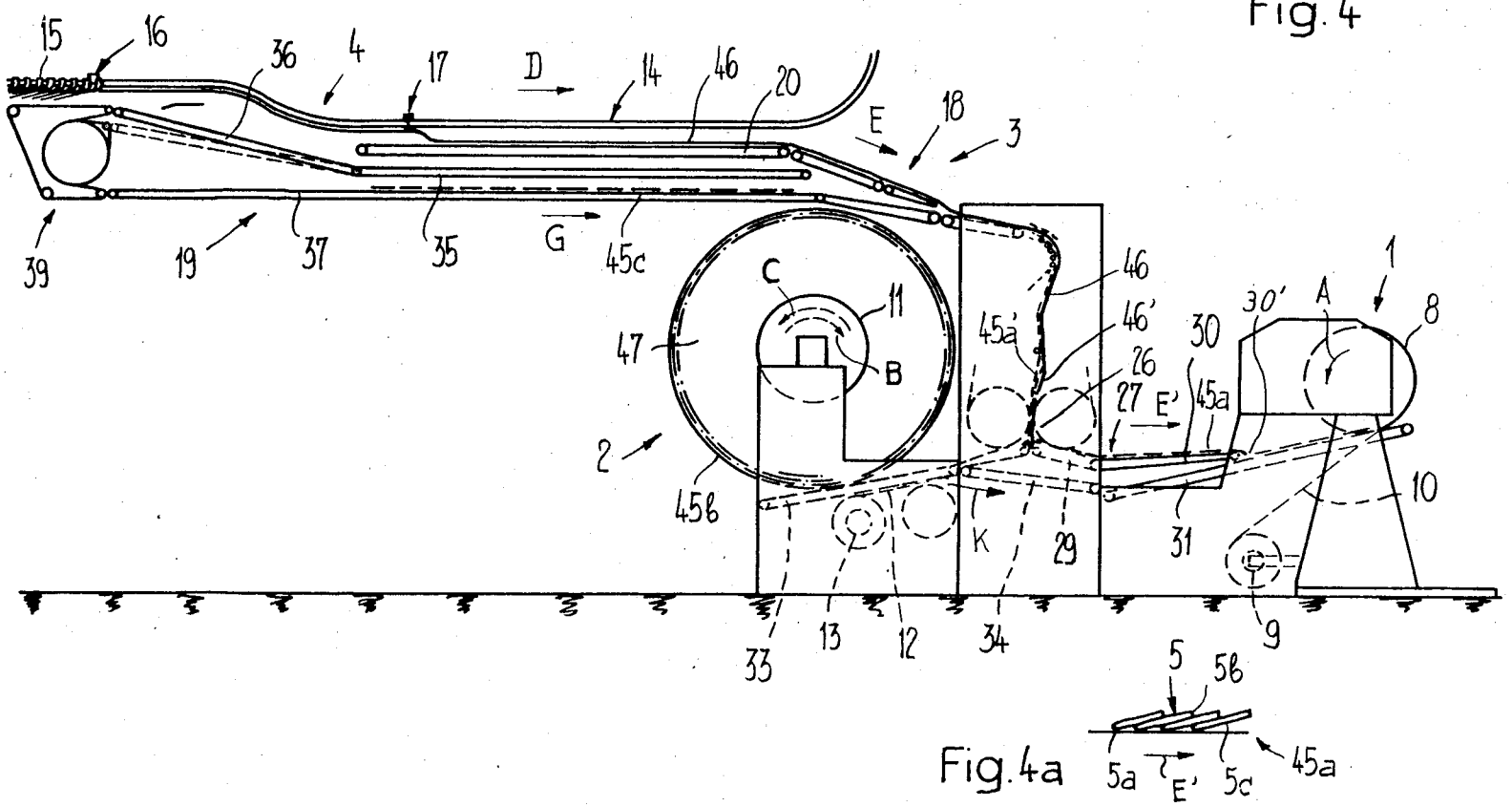

As soon as the rear end of the intermediate section 45b has passed the switch or turnout 26, the switch or turnout 26 is thrown to the lateral conveying path 27 with the result that the printed products 5 of the initial section 45a are conducted to the winding mandrel or core 8 in the winding station 1 (cf. FIG. 4).

As will also be seen from FIG. 4, the first releasing device 16 is again rendered inactive as soon as all printed products 5 of the terminal section 45c have been released from the arriving imbricated product formation S. The subsequent printed products which belong to the second subformation 46 are now deposited upon the belt conveyor 20 of the main conveying path 18 just as were the printed products 5 of the intermediate section 45b of the first subformation 45 and are conveyed via the belt conveyor 20 toward the switch or turnout 26 and are conveyed by the latter to the winding mandrel or core 8.

Since, as has already been mentioned, the initial section 45a does not uninterruptedly adjoin the intermediate section 45b but passes through the vertical conveying path or run 24a of the main conveying path 18 at a spacing or distance therefrom, the forward end 46' of the second subformation 46 overlies the rear end 45a' of the initial section 45a in the region of the entry of the branch conveying path 19, as can be seen from FIG. 4. While the second subformation 46 is conducted to the winding station 1 via the main conveying path 18, the terminal section 45c moves along the branch conveying path 19 just as the initial section 45a did earlier and, after passing through the turning or reversing device 39, is brought into a waiting position upon the belt conveyor 37 (cf. FIG. 4).

While the initial section 45a now runs toward the winding mandrel or core 8 via the lateral conveying path 27, the winding mandrel or core 11 with the intermediate coil or wound package 47 can now be braked and driven in the opposite sense, i.e. in the direction of the arrow C. Simultaneously, the direction of rotation of the supply roll 16 and the transport direction of the belt conveyor 33 are reversed. The printed products of the intermediate section 45b are now unwound from the intermediate coil or wound package 47 and brought to the belt conveyor 31 via the belt conveyors 33 and 34.

Figures 5, 5A, 5B:
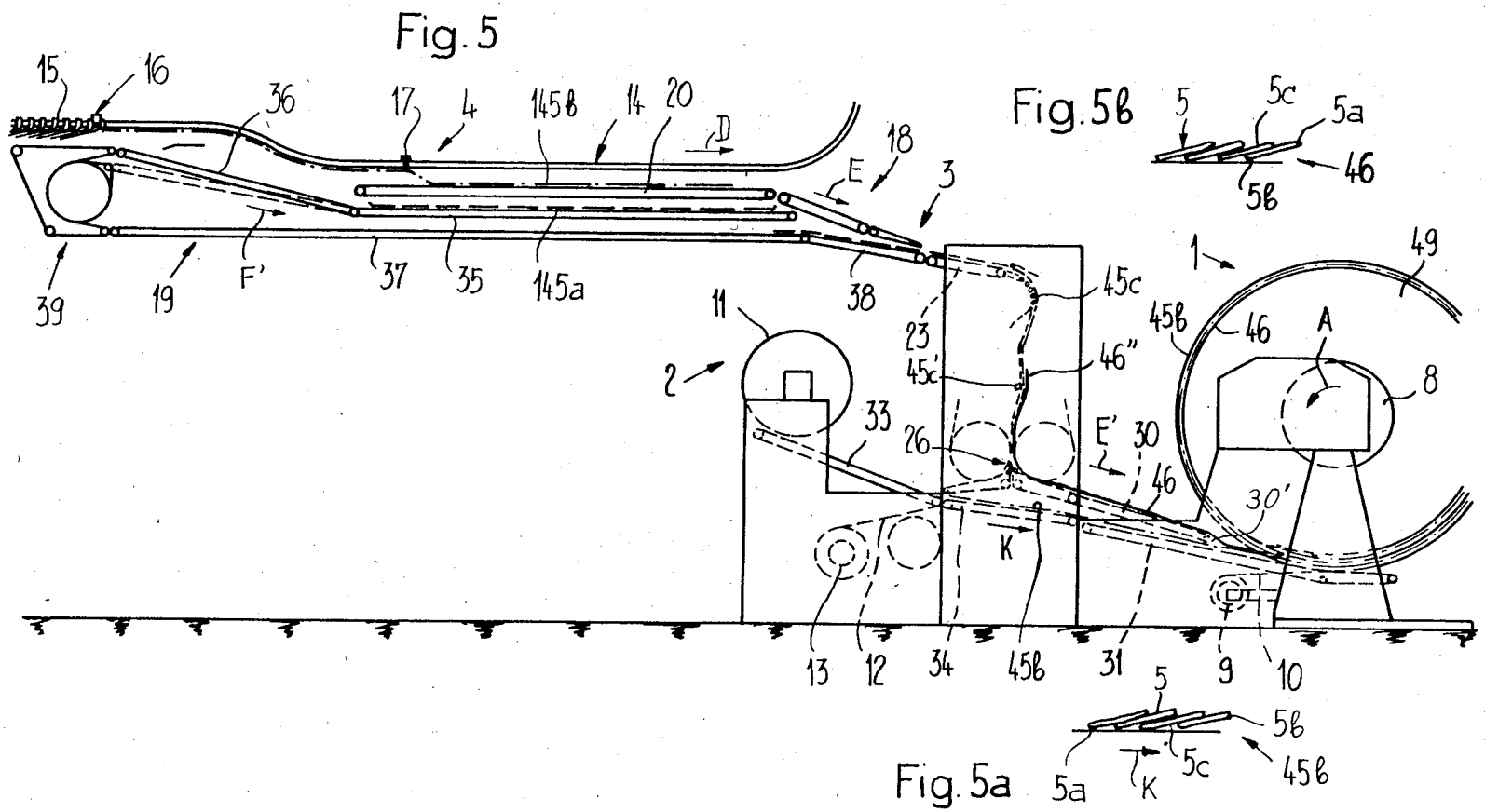

The unwinding process is controlled such that the intermediate section 45b joins the initial section 45a already approaching the winding mandrel or core 8 without interruption at the junction point 30' of the belt conveyors 30 and 31. At this junction point 30' of the belt conveyors 30 and 31 a superposition of the intermediate section 45b of the first subformation 45 and of the second subformation 46 takes place, as can be seen in FIG. 5. The initial section 45a and the two superposed product formations 46 and 45b are wound up on the winding mandrel or core 8 conjointly with the winding strap or band 10 to form a storage coil or wound package 49, as is explained in more detail in the previously mentioned British Patent Publication No. 2,111,028.

As shown in the FIGS. 4a and 5a, the printed products, seen in the corresponding transport direction E' or, respectively, K, have the same mutual position or orientation within both of the product formations 45a and 45b approaching the winding mandrel or core 8. Each printed product 5 overlies the preceding printed product 5 such that its leading edge 5b is closer to the winding mandrel or core 8, respectively to the storage coil or wound package 49 forming thereupon. These leading edges 5b are formed by the edges which were trailing edges in the arriving or delivered imbricated product formation S.

The printed products 5 in the second subformation 46 have the same position or orientation as they did in the arriving or delivered imbricated product formation S, as can be seen in FIG. 5b. Therefore, the leading edges 5a of the printed products 5 in the second subformation 46 are also closer to the winding mandrel or core 8, respectively to the storage coil or wound package 49.

The terminal section 45c situated in the waiting position or state upon the belt conveyor 37 is pushed forward in the direction of the arrow D and conducted to the main conveying path 19 at the proper time by the belt conveyors 37 and 38. Here the head or starting portion 45c' of the terminal section 45c impinges upon the tail or trailing portion 46'' of the second subformation 46, so that an overlapping of the head 45c' and the tail 46'' of both formations 45c and 46 occurs, as can be seen in FIG. 5. The terminal section 45c is conducted via the lateral conveying path 27 toward the storage coil or wound package 49. At the junction point 30' of both conveyors 30 and 31, the terminal section 45c, in which the printed products 5 have the same position or orientation as within the initial section 45a and the intermediate section 45b (cf. FIGS. 4a and 5a), now intimately joins the intermediate section 45b. The terminal section 45c is now also wound up on the storage coil or wound package 49.

Figures 6, 6A:
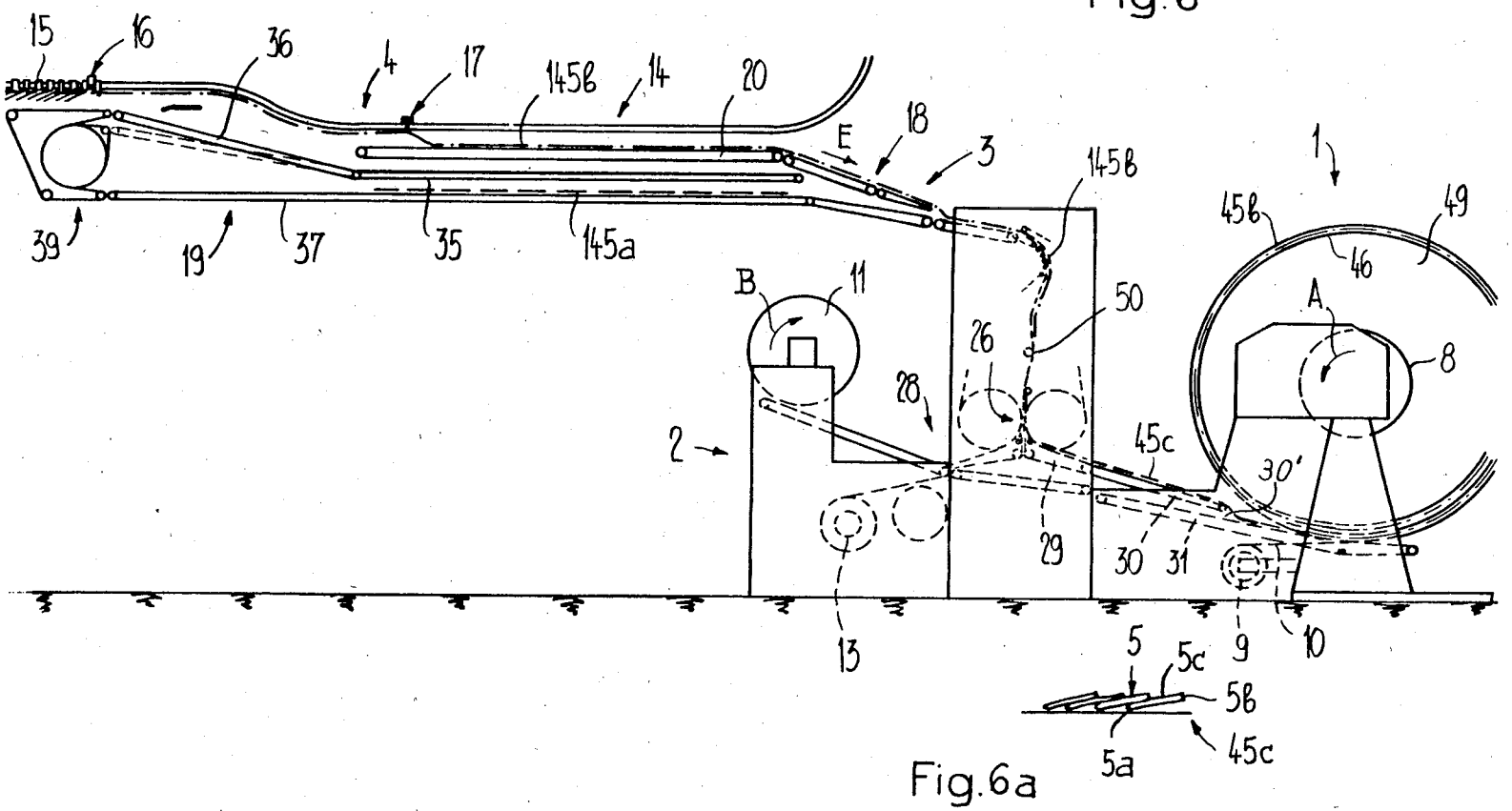

As shown in FIGS. 5 and 6, the printed products 5 of the arriving or delivered imbricated product formation S following the second subformation 46 are again conducted either to the branch conveying path 19 or to the main conveying path 18 in the manner previously described. In such FIGS. 5 and 6, the next subformation is designated with the reference numeral 145 and the initial and intermediate sections thereof are designated with the reference characters 145a and 145b.

Conveying the terminal section 45c from the branch conveying path 19 to the main conveying path 18 such that an overlapping between this terminal section 45c and the second subformation 46 occurs makes it possible to form a gap 50 (cf. FIG. 6) between the terminal section 45c and the intermediate section 145b of the subsequent subformation 145. This permits an unrestricted throwing of the switch or turnout 26, so that this section 145b can again be conducted to the appropriate winding station 2. Between the time when the intermediate section 45b is completely wound off the winding mandrel or core 11 and the time when the intermediate section 145b of the subsequent subformation 145 reaches the switch or turnout 26 and is conducted to the lateral transport path 27, there is now enough time available to again set the winding mandrel or core 11 in rotation in the direction of winding-up, i.e. in the direction of the arrow B.

While the intermediate section 145b of the subsequent subformation 145 is wound up to an intermediate coil or wound package in the winding station 2, the winding and storage unit 6 with the completely wound storage coil or wound product package 49 can be exchanged for a new winding and storage unit 6 with an empty winding mandrel or core 8, as is explained in more detail in the previously mentioned British Patent Publication No. 2,111,028.

Figure 8:
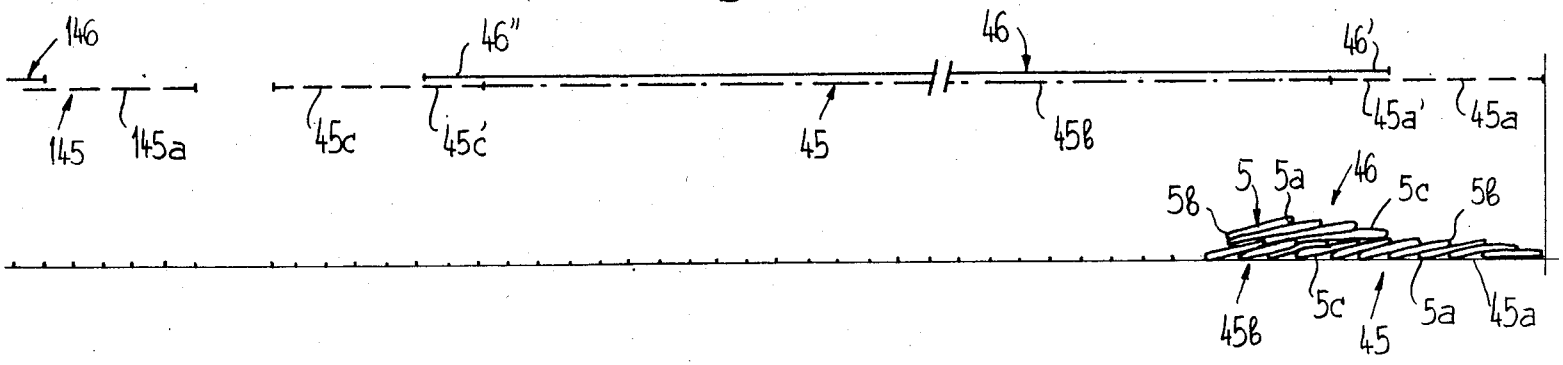
FIG. 8 schematically shows an unwinding of the storage coil or wound package.

An unwinding of the storage coil or wound package 49 is shown in FIG. 8. As can be seen from this illustration, the first subformation 45, which is outermost in each coil layer of the storage coil or wound package 49, is longer than the second subformation 46. The latter overlaps, as previously described, the initial and terminal sections 45a and 45c with its ends 46' and 46'' respectively.

As can be seen from the lower part of FIG. 8, the printed products 5 in the first subformation 45 have a different mutual position or orientation than in the second subformation 46. The uppermost sides 5c in the arriving or delivered imbricated product formation S are also upper sides in the second subformation 46, i.e. are closer to the winding mandrel or core 8, while these upper sides 5c are undersides in the first subformation 45, i.e. they lie upon the side of the subformation 45 most remote from the winding mandrel or core 8.

This differing mutual position or orientation of the printed products 5 in both subformations 45 and 46 makes it possible to re-form an imbricated product formation when unwinding or emptying the storage coil or wound package 49 in the manner described in the previously mentioned British Patent Publication No. 2,112,758, in which imbricated product formation the printed products 5 have the same mutual position or orientation as in the original imbricated product formation S supplied by the transporter 14. The protrusion of the first, precursive imbricated product subformation 45 beyond the second subformation 46 at both ends is the prerequisite for avoiding gaps in the imbricated product formation newly formed when unwinding.

Since, as already mentioned, the leading edges 5b and 5a in the subformations 45 and 46 lie upon the side of the corresponding subformation 45 or 46 nearer to the winding mandrel or core 8, respectively to the storage coil or wound package 49, it is now possible for each coil layer formed by the two superposed subformations 45 and 46 to rotate in relation to the next outer coil layer in the winding-up rotary direction A during the winding-up process without mutual blocking or interference occurring. This freedom of relative rotation between adjacent coil layers makes it possible to wind up the coil or wound package 49 from the interior in the manner of a clock spring and thereby to compact the coil or wound package 49.

By dividing the first, precursive subformation 45 into an initial section 45a, an intermediate section 45b and a terminal section 45c before forming the intermediate coil or wound package 47 and by conducting the initial and terminal sections 45a and 45c along a branch conveying path 19, it is now possible to gain the time necessary for reversing the direction of rotation B, respectively C, of the winding mandrel or core 11 and to also form gaps 48 and 50 which permit interference-free throwing of the switch or turnout 26. Therefore, all printed products 5 can be processed by a single storage winding station 1 and a single intermediate winding station 2, even with continuously arriving printed products 5. By means of the turning or reversing device 39 arranged in the branch conveying path 19 it can be achieved in simple manner that the printed products 5 also have the desired correct mutual position or orientation within the initial and the terminal sections 45a and 45b, i.e. have the same mutual position or orientation as within the intermediate section 45b approaching the winding station 1. It will be understood that flat products other than printed products can also be wound up to form a storage coil or wound package in the manner described.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. In a method for storing substantially flat products, especially printed products, arriving in a continuous formation, especially an imbricated product formation, wherein the products of a first, precursive subformation of said arriving formation and the products of a second subformation of said arriving formation following said first subformation, after a preliminary winding-up of said products of said first subformation to form an intermediate coil, are simultaneously and conjointly wound up at a winding station to form a storage coil, the improvement comprising the steps of:

separating an initial section and a terminal section of said first subformation from an intermediate section lying therebetween;

winding up exclusively products of said intermediate section to form an intermediate coil;

infeeding the products of the second subformation;

unwinding the products of the intermediate section of the first subformation from the intermediate coil during said infeeding of the products of the second subformation;

adjoining said initial section before and said terminal section after said intermediate section unwound from said intermediate coil; and conjointly winding up both said first and second subformations to form a storage coil.

2. The method as defined in claim 1, further including the step of:

depositing said products of said second subformation upon the products of said first subformation.

3. The method as defined in claim 1, wherein:

said intermediate coil being formed has an axis of rotation and an associated winding strap;

said storage coil being formed having an axis of rotation and an associated winding strap;

said products of the first subformation being conducted to the intermediate coil being formed at a region beneath said axis of rotation thereof and being wound up thereupon conjointly with said therewith associated winding strap; and the products of the first and second subformations being conducted to the storage coil being formed at a region beneath said axis of rotation thereof and being wound up thereupon conjointly with said therewith associated winding strap.

4. The method as defined in claim 1, further including the steps of:

conducting said products of said intermediate section of the first subformation to said intermediate coil which is being formed and with sides of said products of the intermediate section which were upper sides in said arriving formation now facing downward;

inverting the products of said initial section and the products of said terminal section such that sides thereof which were upper sides in the arriving formation face downward; and winding up the products of the initial section and the products of the terminal section on said storage coil being formed.

5. The method as defined in claim 1, wherein:

said products of the arriving formation arrive in imbricated product formation and have leading edges; and conducting said first subformation and said second subformation to said storage coil being formed with said leading edges of the products nearer to the storage coil being formed.

6. The method as defined in claim 1, wherein:

said products arrive in imbricated product formation and have trailing edges; and conducting said intermediate section of said first subformation to said intermediate coil being formed with said trailing edges of the products adjacent to the intermediate coil being formed.

7. In a method for storing substantially flat products, especially printed products, arriving in a continuous formation, especially an imbricated product formation, wherein the products of a first, precursive subformation of said arriving formation and the products of a second subformation of said arriving formation following said first subformation, after a preliminary winding-up of said products of said first subformation to form an intermediate coil, are simultaneously and conjointly wound up at a winding station to form a storage coil, the improvement comprising the steps of:

separating an initial section and a terminal section of said first subformation from an intermediate section lying therebetween;

winding up products of said intermediate section to form an intermediate coil;

infeeding the products of the second subformation;

unwinding the products of the intermediate section of the first subformation from the intermediate coil during said infeeding of the products of the second subformation;

adjoining said initial section before and said terminal section after said intermediate section unwound from said intermediate coil;

conjointly winding up both said first and second subformations to form a storage coil;

conducting said initial section into a branch conveying path;

conducting said intermediate section past said initial section to the location where there is formed the intermediate coil; and subsequently transporting said initial section to said winding station where there is formed the storage coil.

8. The method as defined in claim 7, further including the steps of:

transporting said initial section and said intermediate section along a common conveying path.

9. The method as defined in claim 8, further including the steps of:

transporting said initial section along said common conveying path at a distance behind said intermediate section.

10. The method as defined in claim 7, further including the steps of:

conducting said terminal section of said first subformation into a branch conveying path;

conducting said second subformation past the terminal section to said winding station;

the second subformation having a first end and a second end;

said initial section of said first subformation having a rear end;

the terminal section of the first subformation having a front end; and assembling the second subformation with the initial section and with the terminal section of the first subformation such that said first end of the second subformation is in overlapping relationship with said rear end of the initial section of the first subformation and said second end of the second subformation is in overlapping relationship with said front end of the terminal section of the first subformation.

11. In a method for storing substantially flat products, especially printed products, arriving in a continuous formation, especially an imbricated product formation, wherein the products of a first, precursive subformation of said arriving formation and the product of a second subformation of said arriving formation following said first subformation, after a preliminary winding-up of said products of said first subformation to form an intermediate coil, are simultaneously and conjointly wound up at a winding station to from a storage coil, the improvement comprising the steps of:

separating an initial section and a terminal section of said first subformation from an intermediate section lying therebetween;

winding up products of said intermediate section to form an intermediate coil;

infeeding the products of the second subformation;

unwinding the products of the intermediate section of the first subformation from the intermediate coil during said infeeding of the products of the second subformation;

adjoining said initial section before and said terminal section after said intermediate section unwound from said intermediate coil;

conjointly winding up both said first and second subformations to form a storage coil;

conducting said terminal section of said first subformation into a branch conveying path; and conducting said second subformation past the terminal section to said winding station.

12. An apparatus for the storage of substantially flat products, especially printed products, delivered in a continuous formation, especially an imbricated product formation, comprising:

a first winding mandrel arranged at a first winding station and drivable both in said first winding direction and in a second winding direction counter to said first winding direction for forming a storage coil;

a second winding mandrel arranged at a second winding station and drivable in a second winding direction counter to said first winding direction for forming an intermediate coil;

said delivered continuous formation comprising a first, precursive subformation and a second subformation following said first subformation;

means for delivering products of the first subformation and products of said second subformation simultaneously to said first winding station and for delivering products of the first subformation to said second winding station;

means for dividing the first subformation into an initial section, a terminal section and an intermediate section;

said delivering means including conveyor means for conducting exclusively said intermediate section to and from the second winding station; and said delivering means further including branch conveying means for adjoining said initial section ahead of and said terminal section behind the intermediate section being conducted from said intermediate coil.

13. The apparatus as defined in claim 12, further including:

supply means for supplying said delivered continuous formation of products to said delivering means;

said delivering means comprises:

a main conveying path for taking over and selectively conducting said products from said supply means to one of said first and second winding stations; and at least one branch conveying path subsequently connected to said supply means and leading into said main conveying path for guiding the products of said initial section and said terminal section of said first subformation.

14. The apparatus as defined in claim 13, wherein:

said supply means comprises:

a traction member;

individually releasable grippers fastened in mutual spaced relationship upon said traction member; and two releasing devices for said grippers associated with said main conveying path and two releasing devices for said grippers associated with said branch conveying path for selectively delivering one of the main conveying path and the branch conveying path with said products.

15. The apparatus as defined in claim 12, further including:

a first winding strap capable of being maintained under tension and wound between coil layers of a coil being formed connected to said first winding mandrel; and a second winding strap capable of being maintained under tension and wound between coil layers of a coil being formed connected to said second winding mandrel.

16. The apparatus as defined in claim 13, wherein:

said main conveying path comprises:

a first lateral conveying path leading to said first winding station;

a second lateral conveying path leading to said second winding station;

a switch device for selectively delivering one of said first and second lateral conveying paths with said products; and said branch conveying path entering the main conveying path ahead of said switch device.

17. The apparatus as defined in claim 13, further including:

an inverting device for inverting said products of said initial section and said terminal section of said first subformation such that upper sides of said products become undersides thereof and said inverting device being arranged in said branch conveying path.

18. The apparatus as defined in claim 17, further including:

two independent conveyors having opposite transport directions and arranged in said branch conveying path above one another and beneath said supply means;

an axis extending transverse to said transport directions of said two independent conveyors;

said inverting device comprising a turning device for turning said initial section and said terminal section of said first subformation about said axis; and said turning device interconnecting the two independent conveyors.

19. The apparatus as defined in claim 18, wherein:

said two independent conveyors are drivable independently of one another.

20. The apparatus as defined in claim 18, wherein:

said axis extends substantially prependicular to said transport directions of said two independent conveyors.

21. The apparatus as defined in claim 20, wherein:

said main conveying path comprises a conveyor arranged between said supply means and said two independent conveyors of said branch conveying path for taking over said products of said intermediate section of said first subformation from the supply means and for taking over the products of said second subformation for the supply means.

22. An apparatus for the storage of substantially flat products, especially printed products, delivered in a continuous formation, especially an imbricated product formation comprising:

a first winding mandrel arranged at a first winding station and drivable in a first winding direction for forming a storage coil;

a second winding mandrel arranged at a second winding station and drivable in a second winding direction counter to said first winding direction for forming an intermediate coil;

said delivered continuous formation comprising a first, precursive subformation and a second subformation following said first subformation;

means for delivering products of the first subformation and products of said second subformation simultaneously to said first winding station and for delivering products of the first subformation to said second winding station;

means for dividing the first subformation into an initial section, a terminal section and an intermediate section;

said delivering means including conveyor means for conducting said intermediate section to and from the second winding station;

said delivering means further including branch conveying means for adjoining said initial section ahead of and said terminal section behind the intermediate section being conducted from said intermediate coil;

supply means for supplying said delivered continuous formation of products to said delivering means;

said delivering means comprises:

a main conveying path for taking over and selectively conducting said products from said supply means to one of said first and second winding stations;

at least one branch conveying path subsequently connected to said supply means and leading into said main conveying path for guiding the products of said initial section and said terminal section of said first subformation;

said main conveying path comprising:

a first lateral conveying path leading to said first winding station;

a second lateral conveying path leading to said second winding station;

a switch device for selectively delivering one of said first and second lateral conveying paths with said products; and said branch conveying path entering the main conveying path ahead of said switch device.

23. An apparatus for the storage of substantially flat products, especially printed products, delivered in a continuous formation, especially an imbricated product formation, comprising:

a first winding mandrel arranged at a first winding station and drivable in a first winding direction for forming a storage coil;

a second winding mandrel arranged at a second winding station and drivable in a second winding direction counter to said first winding direction for forming an intermediate coil;

said delivered continuous formation comprising a first, precursive subformation and a second subformation following said first subformation;

means for delivering products of the first subformation and products of said second subformation simultaneously to said first winding station and for delivering products of the first subformation to said second winding station;

means for dividing the first subformation into an initial section, a terminal section and an intermediate section;

said delivering means including conveyor means for conducting said intermediate section to and from the second winding station;

said delivering means futher including branch conveying means for adjoining said initial section ahead of and said terminal section behind the intermediate section being conducted from said intermediate coil;

supply means for supplying said delivered continuous formation of products to said delivering means;

said delivering means comprises:

a main conveying path for taking over and selectively conducting said products from said supply means to one of said first and second winding stations;

at least one branch conveying path subsequently connected to said supply means and leading into said main conveying path for guiding the products of said initial section and said terminal section of said first subformation; and an inverting device for inverting said products of said initial section and said terminal section of said first subformation such that upper sides of said products become undersides thereof and said inverting device being arranged in said branch conveying path.

24. The apparatus as defined in claim 23, further including:

two independent conveyors having opposite transport directions and arranged in said branch conveying path above one another and beneath said supply means;

an axis extending transverse to said transport directions of said two independent conveyors;

said inverting device comprising a turing device for turning said initial section and said terminal section of said first subformation about said axis; and said turning device interconnecting the two independent conveyors.

25. The apparatus as defined in claim 24, wherein:

said two independent conveyors are drivable independently of one another.

26. The apparatus as defined in claim 24, wherein:

said axis extends substantially perpendicular to said transport directions of said two independent conveyors.

27. The apparatus as defined in claim 24, wherein:

said main conveying path comprises a conveyor arranged between said supply means and said two independent conveyors of said branch conveying path for taking over said products of said intermediate section of said first subformation from the supply means and for taking over the products of said second subformation from the supply means.

* * * * *